US008261808B2

(12) United States Patent
Perkowitz

(10) Patent No.: US 8,261,808 B2
(45) Date of Patent: Sep. 11, 2012

(54) MULTIPLE WINDOW SHADE SYSTEM AND METHOD

(76) Inventor: David Perkowitz, Vernon Hills, IL (US)

( * ) Notice: Subject to any disclaimer, the term of this patent is extended or adjusted under 35 U.S.C. 154(b) by 9 days.

(21) Appl. No.: 12/823,578

(22) Filed: Jun. 25, 2010

(65) Prior Publication Data

US 2010/0307698 A1 Dec. 9, 2010

Related U.S. Application Data

(63) Continuation-in-part of application No. 12/793,342, filed on Jun. 3, 2010.

(60) Provisional application No. 61/183,741, filed on Jun. 3, 2009.

(51) Int. Cl.
*E06B 9/08* (2006.01)

(52) U.S. Cl. ..... 160/108; 160/120

(58) Field of Classification Search ..... 160/108–112, 160/84.01, 84.03, 84.04, 38, 39, 115, 243, 160/120; 248/252–260
See application file for complete search history.

(56) References Cited

U.S. PATENT DOCUMENTS

| | | | | | |
|---|---|---|---|---|---|
| 751,800 | A | * | 2/1904 | Mallory | 160/19 |
| 927,090 | A | * | 7/1909 | Anderson | 160/110 |
| 1,437,288 | A | * | 11/1922 | Biesemeyer | 248/252 |
| 1,601,665 | A | * | 9/1926 | Alphin | 160/112 |
| 1,998,777 | A | * | 4/1935 | Dollinger | 160/25 |
| 2,420,977 | A | * | 5/1947 | Pye | 248/258 |
| 2,555,819 | A | * | 6/1951 | Rock | 248/256 |
| 3,883,924 | A | * | 5/1975 | Grabman | 16/94 D |
| 4,114,233 | A | * | 9/1978 | Hamilton | 16/95 R |
| 4,644,991 | A | * | 2/1987 | Boyd | 160/38 |
| 4,953,610 | A | * | 9/1990 | Phillips et al. | 160/84.03 |
| 5,205,334 | A | * | 4/1993 | Judkins | |

* cited by examiner

*Primary Examiner* — David Purol
(74) *Attorney, Agent, or Firm* — Hartman Global IP Law; Gary M. Hartman; Domenica N. S. Hartman

(57) ABSTRACT

A window shade system and method of installing the shade system. The shade system includes first and second shade units and brackets for interconnecting the shade units. The first shade unit includes a first headrail, a roller mounted beneath the first headrail, a first shading material spooled onto the roller, and a device for deploying the first shading material from the roller. The second shade unit includes a second headrail, a second shading material attached to the second head rail, and a device for deploying the second shading material from the second headrail. The brackets secure the headrails together so that, when installed in the window, the first headrail is positioned vertically above and rearward of the second headrail.

17 Claims, 2 Drawing Sheets

MULTIPLE WINDOW SHADE SYSTEM AND METHOD

CROSS REFERENCE TO RELATED APPLICATIONS

This is a continuation-in-part patent application of co-pending U.S. patent application Ser. No. 12/793,342, filed Jun. 3, 2010, which claims the benefit of U.S. Provisional Application No. 61/183,741, filed Jun. 3, 2009. The contents of these prior patent applications are incorporated herein by reference.

BACKGROUND OF THE INVENTION

The present invention generally relates to window shades, and more particularly to a window shade system and method that uses at least two shade units and a compact configuration by which the shade units can be installed on the same window.

Various different types of window coverings are known. Notable examples include roller shades and Roman shades, also generally referred to as blinds. Roller shades typically comprise a sheet material spooled on a roller, from which the sheet material is unrolled to cover a window. In contrast, Roman shades are typically stowed in a folded configuration and held in the stowed position by a string or other type of cord attached to a rail at the bottom edge of the shade. The shade is then deployed by letting out the string to lower the bottom edge of the shade. Certain advantages and desirable effects can be achieved with different types of shades and the different types of sheet materials that can be used in their construction. As such, more than one type of window shade may be desired for a window, for example, one shade to provide a shading effect during the day and a second shade capable of blocking more light to provide privacy at night. Dual shades have been implemented with independent hardware that are individually installed in a window, as well as with integrated hardware that can be installed as a single unit.

BRIEF DESCRIPTION OF THE INVENTION

The present invention provides a window shade system and a method of installing the window shade system.

According to a first aspect of the invention, the window shade system includes first and second shade units and brackets for interconnecting the first and second shade units. The first shade unit includes a first headrail, a roller mounted beneath the first headrail, a first shading material spooled onto the roller to define a stowed position of the first shading material, and means for deploying the first shading material from the roller to define a deployed position in which the first shading material is adapted to at least partially cover a window. The second shade unit is independently operable of the first shade unit and includes a second headrail, a second shading material attached to the second headrail, and means for deploying the second shading material from the second headrail to define a stowed position in which the second shading material is collapsed and collected immediately beneath the second headrail, as well as to define a deployed position in which the second shading material is adapted to at least partially cover the window. The second shading material preferably has a second shading effect that is different from the first shading effect of the first shade unit. The brackets secure the first and second headrails together so that, when installed in the window, the first headrail is positioned vertically above the second headrail and the first and second shading materials are horizontally spaced from each other when in their respective deployed positions.

Other aspects of the invention include a method of installing the window shade system described above.

A significant advantage of this invention is that a compact configuration is provided by which two or more window shade units can be installed on the same window.

Other aspects and advantages of this invention will be better appreciated from the following detailed description.

DETAILED DESCRIPTION OF THE INVENTION

Figure 1:
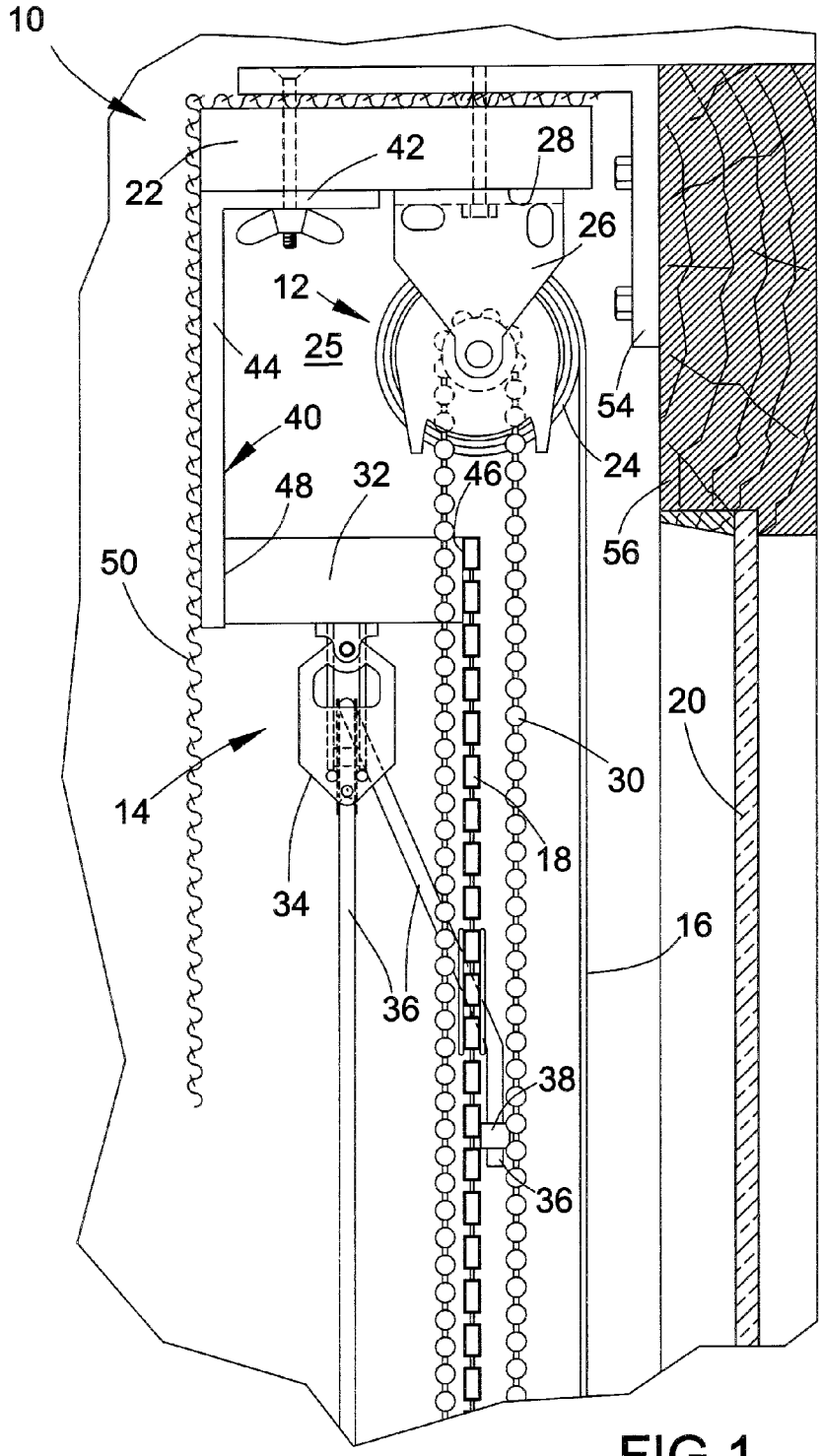
FIG. 1 represents a cross-sectional view of a window shade system in accordance with an embodiment of this invention.
Figure 2:
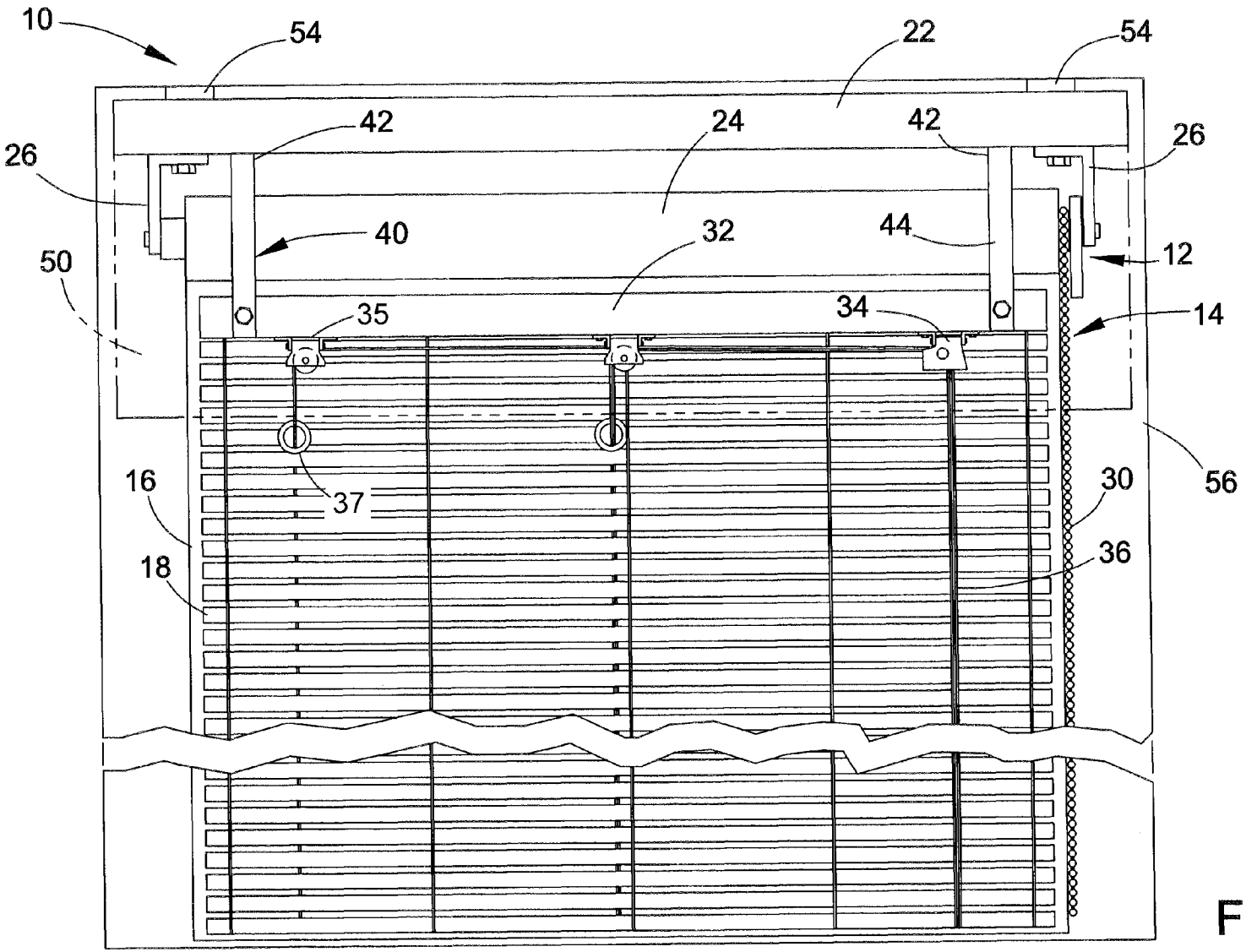
FIG. 2 represents a front view of the window shade system of FIG. 1, with a valance shown in phantom to reveal hardware of the system.

FIGS. 1 and 2 depict a window shade system 10 comprising two interconnected shade units 12 and 14 that are equipped with different types of shade materials and capable of being independently operated. To facilitate the description of the system 10 provided below, the terms "vertical," "horizontal," "front," "rear," "side," "upper," "lower," "above," "below," "right," "left," etc., will be used in reference to the perspective of an operator facing a window 20 in which the system 10 is installed, corresponding to the orientation of the system 10 looking toward the right in FIG. 1 and the front view of the system 10 shown in FIG. 2. For example, the shade unit 12 is shown as being above and to the rear of the shade unit 14 when installed as a window treatment for the window 20 shown in FIGS. 1 and 2. As evident from FIG. 1, terms such as "above" and "rear" are intended to serve as limitations to the construction and installation of the system 10.

In the embodiment shown in FIGS. 1 and 2, a first of the shade units 12 is represented as a roller-type shade unit and the second shade unit 14 is represented as a Roman-type shade unit. The first and second shade units 12 and 14 are equipped with shading materials 16 and 18, shown as sheet materials of types often used with roller and Roman-type shade units. The shading materials 16 and 18 preferably have different shading effects, for example, the shading material 18 of the second shade unit 14 may be more translucent than the shading material 16 of the first shade unit 12, such that the front shading material 18 may be used to provide a light-dimming effect and the rear shading material 16 can be used to block significantly more light to provide greater privacy. As well known to those of ordinary skill in the art, the shading effects of the shading materials 16 and 18 can be achieved by using sheet materials of different types, compositions, thicknesses, densities, etc., and therefore the various materials capable of these effects will not be described in any detail here.

The first shade unit 12 includes a headrail 22 and a roller 24 that is mounted beneath the headrail 22 with brackets 26 (only one of which is shown) attached to the lower surface 28 of the headrail 22. The shading material 16 is spooled onto the roller 24, defining what will be termed a stowed position of the shading material 16. Operation of the roller 24 is shown as being with one or more chains 30, as is common with roller-type shades known in the art. As is also common for roller-type shades, the roller 24 can be a spring-biased and clutch-operated design to assist with respooling the shading material 16 to its stowed position. The shading material 16 is preferably sized so that when in its fully deployed position, the material 16 at least partially covers the window 20, and more preferably completely covers the window 20.

Similar to the shade unit 12, the lower shade unit 14 includes a headrail 32 to which the shading material 18 is attached, and a cordlock 34 attached to the headrail 32 and with which the shading material 18 is raised (stowed) and lowered (deployed) with a cord 36. Notably, the headrail 32 has a smaller projection in the front-rear direction than the headrail 22, so that the headrail 32 is entirely accommodated beneath the headrail 22 and in front of the shading material 16. As seen in FIG. 1, the shading material 18 is attached to a rear-facing lateral surface 46 of the headrail 32, which is vertically aligned below the roller 24 of the upper shade unit 12. As shown in FIG. 1, the roller 24 is within a cavity 25 defined between the headrails 22 and 32. When in the stowed position, the shading material 18 is preferably collapsed and collected as cascading folds beneath the headrail 32, as is typical for Roman-type shades. The shading material 18 unfolds as it is deployed with the cord 36, which is routed through the cordlock 34 and preferably one or more pulleys 35 before being routed through the shading material 18 (such as through grommets 37) to a backside of the shading material 18, and finally routed through one or more cord guides 38 before being attached to a lowermost cord guide 38 near the bottom edge of the shading material 18. As also noted for the shade unit 12, the shading material 18 of the second shade unit 14 can be sized so that when in its fully deployed position, the material 18 at least partially covers the window 20 and more preferably completely covers the window 20.

The shade units 12 and 14 are represented as interconnected with brackets 40 (only one of which is shown) secured to the headrails 22 and 32. The brackets 40 are configured so that, when installed in the window 20, the headrail 22 is positioned vertically above and to the rear of the headrail 32, with the result that the headrail 22 is horizontally closer to the window 20 and the shading materials 16 and 18 are horizontally spaced from each other with the shading material 16 closer to the window 20 than the shading material 18. Each bracket 40 has an upper end 42 attached to the lower surface 28 of the headrail 22 at a location vertically above the headrail 32 and in front of and adjacent to the brackets 26 that mount the roller 24 to the headrail 22. Each bracket 40 also has a lower end 44 attached to a front-facing lateral surface 48 of the headrail 32. As seen in FIG. 1, the bracket 40 has an L-shaped cross-section, such that its upper and lower ends 42 and 44 define horizontal and vertical legs of the L-shape.

FIG. 1 further shows the window shade system 10 as comprising a valance 50 attached to the headrail 22 and hanging downward to conceal the headrails 22 and 32 and the brackets 40.

The window shade system 10 can be installed by securing the headrail 32 to the headrail 22 with the brackets 40, and then installing the system 10 as an integral unit 10 by attaching the headrail 22 with mounting brackets 54 (only one of which is shown) adjacent the window 20, for example, above the window frame 56 as shown or within the window frame 56, in accordance with conventional practice. To accommodate the shade system 10 and its two headrails 22 and 32, the mounting brackets 54 may be of a type known as extended "New York" brackets, though the use of various other types of mounting hardware is also possible. The shading materials 16 and 18 can then be deployed as desired, for example, individually to obtain their respective different shading effects, or together so that the shading material 18, which may be more aesthetically pleasing as a result of its cascading configuration, is disposed in front of the shading material 16.

While the invention has been described in terms of a specific embodiment, it is apparent that other forms could be adopted by one skilled in the art. Therefore, the scope of the invention is to be limited only by the following claims.

The invention claimed is:

1. A window shade system comprising:

a first shade unit comprising a first headrail, a roller mounted beneath a rearward portion of the first headrail, a first shading material having a first shading effect and spooled onto the roller to define a stowed position of the first shading material, and means for deploying the first shading material from the roller to define a deployed position in which the first shading material is adapted to at least partially cover a window;

a second shade unit independently operable of the first shade unit, the second shade unit comprising a second headrail, a second shading material attached to the second headrail, and means for deploying the second shading material from the second headrail to define a stowed position in which the second shading material is collapsed and collected immediately beneath the second headrail and to define a deployed position in which the second shading material is adapted to at least partially cover the window, the second shading material having a second shading effect that is different than the first shading effect of the first shade unit;

brackets securing the first and second headrails together so that, when installed in the window, the first headrail is positioned vertically above the second headrail so as to define a cavity therebetween, the rearward portion of the first headrail extends rearwardly of the second headrail, the roller is mounted beneath the rearward portion of the first headrail so as to be within the cavity and rearward of the second headrail and the second shading material, and the first and second shading materials are horizontally spaced from each other when in their respective deployed positions; and means attached to the first headrail for concealing the headrails, the cavity, the roller within the cavity, and the brackets.

2. The window shade system according to claim 1, wherein each of the brackets has an upper end attached to a lower surface of the first headrail of the first shade unit and a lower end attached to a front-facing lateral surface of the second headrail of the second shade unit.

3. The window shade system according to claim 2, wherein the upper end of each of the brackets is attached to the lower surface of the first headrail adjacent the roller of the first shade unit.

4. The window shade system according to claim 3, wherein the upper end of each of the brackets is vertically above the second headrail of the second shade unit.

5. The window shade system according to claim 1, wherein each of the brackets has an L-shaped cross-section having an upper horizontal leg and a lower vertical leg, the upper horizontal leg is attached to a lower surface of the first headrail of the first shade unit, and the lower vertical leg is attached to a front-facing lateral surface of the second headrail of the second shade unit.

6. The window shade system according to claim 5, wherein the upper horizontal leg of each of the brackets is vertically above the second headrail of the second shade unit.

7. The window shade system according to claim 1, wherein the first and second headrails are secured together with only the brackets.

8. The window shade system according to claim 1, wherein the second headrail is entirely accommodated beneath the first headrail and in front of the first shading material when the first shading material is in its deployed position.

9. The window shade system according to claim 1, wherein the second shading material is more translucent than the first shading material.

10. The window shade system according to claim 1, wherein the concealing means comprises a valance attached to the first headrail and covering the first and second headrails.

11. The window shade system according to claim 1, wherein the window shade system does not comprise a shade unit in addition to the first and second shade units.

12. A method of installing the window shade system of claim 1, the method comprising:

securing the second headrail to the first headrail with the brackets; and attaching the first headrail adjacent the window so that the first headrail is positioned vertically above the second headrail and horizontally closer to the window than the second headrail; and deploying the first and second shading materials to their respective deployed positions so that the first and second shading materials are horizontally spaced from each other.

13. The method according to claim 12, wherein the securing step comprising attaching an upper end of each of the brackets to a lower surface of the first headrail of the first shade unit and attaching a lower end of each of the brackets to a front-facing lateral surface of the second headrail of the second shade unit.

14. The method according to claim 13, wherein the upper end of each of the brackets is attached to the lower surface of the first headrail adjacent the roller of the first shade unit.

15. The method according to claim 14, wherein the upper end of each of the brackets is vertically above the second headrail of the second shade unit.

16. The method according to claim 12, wherein the first and second headrails are secured together with only the brackets.

17. The method according to claim 12, wherein following the attaching step the second headrail is entirely accommodated beneath the first headrail and in front of the first shading material when the first shading material is in its deployed position.

* * * * *